United States Patent [19]

Burke

[11] 4,072,835

[45] Feb. 7, 1978

[54] FLUID TYPE INERTIA SWITCH HAVING RESETTABLE PLUNGER AND CONE SHAPED RETAINER

[75] Inventor: Courtney L. Burke, Simi Valley, Calif.

[73] Assignee: Albert M. Eisner, Los Angeles, Calif. ; a part interest

[21] Appl. No.: 702,540

[22] Filed: July 6, 1976

[51] Int. Cl.[2] ..... H01H 35/14; H01H 29/20

[52] U.S. Cl. ..... 200/61.47; 200/61.5; 200/61.52; 200/194; 200/209; 200/210; 200/220

[58] Field of Search ..... 200/33 A, 61.47, 61.5, 200/61.52, 193, 194, 199, 209, 210, 214, 220, 222, 223, 226, 227

[56] References Cited

U.S. PATENT DOCUMENTS

| | | | |
|---|---|---|---|
| 1,858,191 | 5/1932 | Hadley et al. | 200/61.47 |
| 2,291,236 | 7/1942 | Kilgour | 200/61.47 |
| 2,862,073 | 11/1958 | Brutscher, Sr. et al. | 200/61.47 X |
| 3,829,639 | 8/1974 | Yauchler | 200/61.47 |

FOREIGN PATENT DOCUMENTS

| | | | |
|---|---|---|---|
| A79,172 | 9/1962 | France | 200/61.47 |
| 721,772 | 3/1932 | France | 200/61.47 |
| 387,509 | 2/1933 | United Kingdom | 200/61.47 |
| 504,622 | 4/1939 | United Kingdom | 200/61.47 |

*Primary Examiner*—James R. Scott
*Attorney, Agent, or Firm*—Lyon & Lyon

[57] ABSTRACT

A resettable switch is disclosed having a conductor maintained in contact with a reservoir of mercury to conduct current therethrough during normal operation. During impact or roll over, the mercury is spilled from the reservoir and prevented from returning thereto by cone-shaped retainers maintained in a telescoped relation by a spring, thereby opening the switch. The switch may be reset by depressing a plunger which aligns slots in the telescoped retainers, which permits mercury to return to the reservoir.

15 Claims, 2 Drawing Figures

FLUID TYPE INERTIA SWITCH HAVING RESETTABLE PLUNGER AND CONE SHAPED RETAINER

BACKGROUND

Department of Transportation statistics indicate that fires are one of the major causes of fatalities in automobile accidents. In turn, a major cause of such fires is shorted electrical circuits in the automobile, causing sparks which ignite gasoline vapors. A shorted automobile battery, as where sheet metal is forced against both battery terminals during a collision, is a frequent cause of such fires, because the high current available from such devices facilitates sparking. Thus, a need has existed for a device suitable for prevention of battery shorts. Further, since gasoline vapors may permeate a vehicle following a collision or other accident, a device suitable for preventing electrical shorts elsewhere in the vehicle has been needed.

One means, well known in the art, for disconnecting an electrical circuit is a mercury tip switch, which typically comprises a reservoir of mercury disposed between two electrical contacts. When the circuit is to be completed—i.e., the switch closed — the switch is tipped so that the mercury strikes both contacts simultaneously. When the switch is to be opened, the switch is tipped so that a gap exists between the mercury and at least one of the contacts. The difficulty with such tip switches in preventing sparking during automotive impact or roll over is that the switch may open for a moment, but then return to the closed condition. Such a return to the closed condition would render the switch valueless since electrical sparking, and therefore fires, could be started when the switch returned to the closed position. Also, such tip switches typically have not been capable of carrying the currents required of a car battery during starting and other operations.

Thus, a need has existd for a tip switch capable of carrying the currents supplied by a car battery and remaining in the open position upon impact or roll over until reset.

SUMMARY OF THE INVENTION

The present invention relates to switches generally, and more particularly to resettable mercury tip switches. The present invention is a sophisticated mercury tip switch which remains open upon impact or roll over by preventing the mercury from returning to the closed switch position. Further, the switch may be reset by means of a spring loaded plunger so that electrical power may, if desired, be restored to the vehicle following the accident.

In simplest terms, the present invention comprises a reservoir of mercury contained within a cone shaped well, and a conductor maintained during normal operation in electrical contact with the reservoir of mercury. A switch casing houses the well and reservoir of mercury in addition to providing one terminal of the switch. The remaining switch terminal is provided by the housing for the conductor. An insulating cap is maintained between the switch casing and the conductor housing to prevent inadvertent shorting of the switch.

Upon impact or roll over, the reservoir of mercury is spilled out of the cone shaped retaining well into a surrounding, somewhat larger reservoir, thereby breaking the electrical circuit through the switch. The mercury, once spilled, is prevented from returning to the well by means of a retaining lip on the cone shaped retainer over which the mercury cannot pass. Since the mercury cannot pass over the retaining lip, reconnection of the circuit is prevented. A second cone shaped retainer, having a similar retaining lip over which the mercury cannot pass, prevents inadvertent shorting during roll over.

The switch is normally connected to whichever terminal of the car battery is not considered ground, that is, if the electrical system of the vehicle is negative ground, the switch is typically connected to the positive battery terminal. Thus, when the circuit through the switch is opened, the complete electrical system is disconnected. In this manner, shorts both between the battery terminal and elsewhere in the electrical systems are prevented.

In order to permit restoration of electrical power to the vehicle if so desired, the switch must be resettable. To this end, slots are provided in both the first and second cone shaped retainers described above, although during normal operation a spring maintains both retainers in a telescoped relation such that the slots do not coincide, and thus do not affect operation. During normal operation, the spring maintains the second cone shaped retainer in an abutting relation to an insulating washer attached to the electrical conductor which normally completes the circuit with the mercury well. The electrical conductor and the attached insulating washer comprise a plunger. Once the circuit has been broken by the mercury being spilled from the well, the plunger may be depressed so as to cause the slots in the second retainer to align with the slots in the first retainer, thereby permitting the mercury to return to the retaining well. Electrical power is therefore restored to the vehicle.

One object of the present invention is to provide an improved mercury switch. A further object of the invention is to provide an improved circuit breaker switch suitable for carrying large currents.

Another object of the present invention is to provide an improved resettable switch suitable for carrying large currents and opening upon impact or roll over.

Other and further objects of the present invention will become apparent in the course of the following detailed description.

THE FIGURES

DETAILED DESCRIPTION OF THE INVENTION

Figure 1:
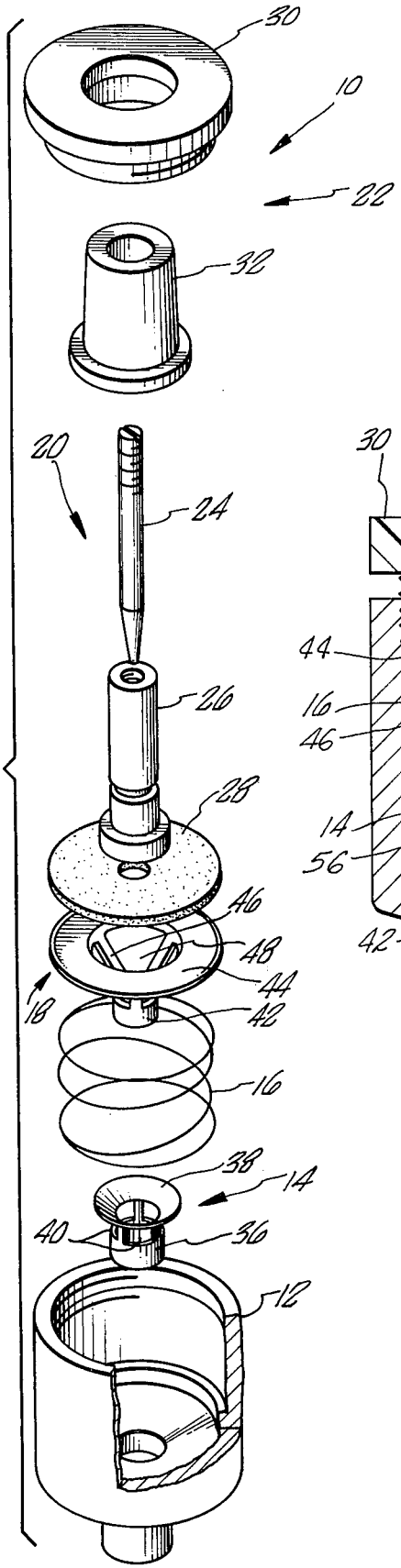
FIG. 1 illustrates an exploded view of the switch.

Attention is drawn to FIG. 1, which illustrates in exploded view a preferred embodiment of the invention. A switch 10 is comprised of a lower casing 12, a cone shaped retaining well 14, a spring 16, a second cone shaped retainer 18, a plunger 20 and a cap 22. The plunger 20 is further comprised of an electrically conducting pin 24 contained within a supporting rod 26. An insulating washer 28, comprised of a highly temperature resistant plastic such as polyethylene or some similar substance, e.g., "Rato", a polyphenylene sulfide having a Rockwell Hardness of R 123, tensile strength of 19,500 psi, and excellent resistance to heat, wear and corrosion, commercially available from Phillips Petroleum Company, is attached to the supporting rod 26 where the pin 24 extends from the rod 26. The cap 22 is comprised of an insulating seal 30, comprised of the same material as insulating washer 28, and a plunger housing 32. The cone shaped retaining well 14 has a lower solid tubular portion 36 and an upper conical retaining lip 38, with slot 40 between the lower solid portion 36 and the upper conical lip 38. The retainer 18 has a lower solid tubular portion 42, a flat upper rim 44 having a greater diameter than the lower tubular portion 42, and a conical shaped section 46 joining the upper rim 44 and the tubular portion 42. Slots are milled in the conical portion 46 and part of the tubular portion 42, so that approximately the lower half of the tubular portion 42 is solid and the upper half thereof is slotted. Slots 48 are also provided in the conical portion 46, such that the conical portion 46 comprises primarily three struts and a conical lip just below the flat rim 44. The inner diameter of the tubular portion 36 of the retainer 14 is slightly greater than the outer diameter of the tubular portion 42 of the retainer 18, so that a slip fit relation may be maintained therebetween.

Figure 2:
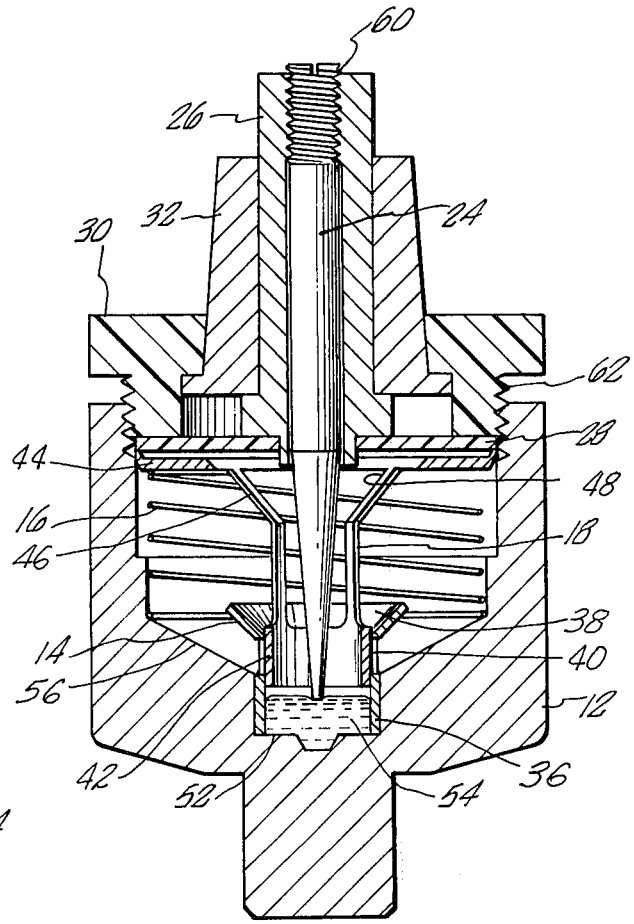
FIG. 2 illustrates a cross-sectional side view of the assembled switch.

The operation of the switch 10 can more readily be seen from FIG. 2, which illustrates a cross sectional side view thereof. The retaining well 14 resides in a press fit relation in a base 52 of lower casing 12. A reservoir of mercury 54 is retained within the well 14. The retainer 18 is engaged in a slip fit relation inside the retaining well 14 so that the lower solid wall of the lower tubular portion 42 of the retainer 18 is congruent with the slot 40 of the retainer well 14. This relation between the retainer 18 and the well 14 is maintained by means of the spring 16, which extends between the outer rim of the lower wall 56 of the internal cavity in the casing 12 and the upper rim 44 of the retainer 18. Spring 16 is preferably made from stainless steel piano wire to insure adequate resiliency and lifetime of operation. The retainer 18 is therefore maintained in an abutting relation to the insulating washer 28, since the washer 28 is held in position by the insulating seal 30 of the cap 22. Because of the spring 16, the insulating washer 28 seals against the insulating seal 30, preventing leakage of mercury into the space therebetween.

As can further be seen from FIG. 2, the pin 24 contained within the plunger 20 maintains an electrical contact with th supporting rod 26, and also maintains contact with the reservoir of mercury 54. In turn, the plunger 20 maintains electrical contact with the plunger housing 32. The lower casing 12 is typically comprised of an electrically conductive material such as aluminum or copper. Thus, as would exist in typical applications, when a battery terminal is connected to the base 52 of the lower casing 12, a completed circuit is made to the plunger housing 32 through the reservoir of mercury 54, the pin 24, the supporting rod 26, and the plunger housing 32. The remainder of the electrical circuit is typically connected to the plunger housing 32. It can thus be seen that, during normal operation, the switch 10 completes a circuit from the battery to the remainder of the electrical system.

In the event of an accident, such a collison or roll over, the reservoir of mercury 54 is spilled over the lip 38 of the well 14. When this occurs, the pin 24 no longer contacts the mercury and therefore the electrical circuit is broken—i.e. the switch is open. Because the lip 38 is some distance above the lower wall 56, the mercury is not able to flow back into the reservoir 54 even when the switch is returned to the upright position. Thus, the electrical circuit remains broken even after impact. Since the circuit is broken at the battery terminal, no sparks are possible from anywhere within the electrical system of the vehicle.

It should be noted that the angle of the retaining lip 38 of the well 14 determines the speed at impact needed to open the switch 10, since the mercury must spill over the lip 38 to open the switch. The mercury may not escape from the reservoir through the slot 40 of the retainer 14 because the solid portion 42 of the retainer 18 blocks off the slot 40. The angle of inclination of the lip 38 therefore determines how readily the mercury will spill into the remaining portion of the casing 12. Since the speed of impact during a collision relates directly to the force needed to spill the mercury over the lip 38, the lip 38 may be adjusted to disconnect the battery for any desired impact speed. However, care should be taken to prevent lowering the angle of the lip 38 to cause opening of the switch 10 during normal operation such as a high speed turn. For example, it has been found that at a lip angle of 37°, mercury will spill over the reservoir upon impact at a speed of 12 miles/-hour, but normal highway driving will not cause the mercury to spill over the lip. In general, the lip 38 should be at an angle of between about 25° and about 50°, preferably from about 35° to about 45°.

Operation of the switch during roll over is analagous. When the switch 10 is inverted, the mercury escapes from the reservoir into the cavity in the casing 12. Contact between the pin 24, the mercury and the electrically conductive outer casing 12 is prevented by the lip of the conical portion 26 of the retainer 18. Thus during roll over the switch opens and again remains open.

In the even that the vehicle operator wishes to reinitiate the electrical circuit, the plunger 20 may be depressed, which will reconnect the circuit through the switch 10 as follows. When the plunger 20 is depressed, the insulating washer 28 depresses the retainer 18 against the force of the spring 16. When the plunger 20 has been depressed a predetermined amount, the slots in the retainer 18 align with the slots 40 in the retaining well 14 and mercury is permitted to reenter the reservoir 54. The switch 10 thereupon returns to the closed conditions since the pin 24 returns to contact with the mercury. It should be noted that, although mercury is used in the preferred embodiment, any highly viscous electrolyte is suitable, as, for example, silver, copper or gold. The viscosity of the electrolyte must be such that no electrolyte will pass between the gaps, if any, between the well 14 and the retainer 18 except when the slots therein are aligned.

Since the primary purpose of the switch 10 is to disconnect a vehicle battery from the remainder of the electrical system in the event of accident, the switch 10 should preferably be located in a vertical position, for example, with the base 36 in contact with the battery terminal. It should further be noted that the pin 24 is secured to the supporting rod 26 by means of a threaded portion 60, which also permits the pin 24 to be adjusted with respect to the reservoir of mercury 54. Further, the insulating cap 30 is secured to the casing 12 by means of a threaded portion 62.

Having fully described the invention, those skilled in the art will recognize from the detailed description herein numerous equivalents which do not depart from the present invention and are to be understood as included herein.

I claim:

1. A resettable switch comprising a casing having a well in the base thereof, a first slotted retainer maintained in a substantially press fit relation in said well and having a cone shaped lip extending above said well, a reservoir of high viscosity electrically conductive liquid contained within said first slotted retainer, a second slotted retainer having a lower tubular portion and an upper rim of a greater diameter than said tubular portion, an electrically insulating cap maintained in sealed relation with respect to said casing and having an electrically conductive plunger housing extending therethrough, an electrically conductive plunger supported within said plunger housing, an insulating washer affixed to said plunger such that a portion of said electrically conductive plunger extends through said washer, and a spring positioned between the base of said casing and said second retainer so as to maintain said second retainer in a telescoped relation with respect to said first retainer to prevent the escape of said electrically conductive liquid from said retainer, whereby an electrically conductive path is formed between said casing and said plunger housing only when said electrically conductive liquid is in said well.

2. A switch as in claim 1 wherein said electrically conductive liquid is mercury.

3. A switch comprising a reservoir of mercury in a casing, a first cone shaped retainer for retaining said reservoir of mercury, a second cone shaped retainer wherein a predetermined portion thereof is maintained in slip fit relation within said first cone shaped retainer, an insulatng cap having an electrically conductive pin therethrough which pin is normally in contact with said reservoir of mercury, and a spring for maintaining said second cone shaped retainer in telescoped relation to said first cone shaped retainer for forming an electrically conductive path through said casing, said mercury, and said conductive pin only when said mercury is retained in said reservoir.

4. A switch as in claim 3 further comprising an insulating washer maintained in an abutting relation to said second cone shaped retainer by said spring, and an angular lip on said first cone shaped retainer for preventing the mercury from returning to said reservoir after said mercury has escaped from said reservoir.

5. A switch as in claim 4 further comprising an insulating washer affixed to said electrically conductive pins and maintained in an abutting relation to said second cone shaped retainer by said spring, and slots in said first and second cone shaped retainers suitable to be aligned when said second cone shaped retainer is depressed by a force applied to said electrically conductive pin, to permit said mercury to return to said reservoir.

6. A switch as in claim 5 wherein said second cone shaped retainer has a lip for preventing shorts between said casing and said electrically conductive pin when said switch is inverted.

7. A switch as in claim 3 wherein said casing is adapted to be coupled to a battery terminal on an automobile.

8. A resettable switch comprising a casing having a well in the base thereof, a first slotted retainer adapted to be maintained in a substantially press fit relation in said well and having a cone shaped lip extending above said well and adapted to maintain within said well a high viscosity electrically conductive liquid, a second cone shaped retainer having a lower tubular portion maintained in slip fit relation within said first cone shaped retainer, an insulating cap having an electrically conductive pin extending therethrough adapted to be normally in contact with such electrically conductive liquid within said well, and a spring to maintain said second cone shaped retainer in telescoped relation to said first cone shaped retainer and thereby form an electrically conductive path through said casing, electrically conductive liquid and said conductive pin when such liquid is retained within said well.

9. The switch of claim 8 further including an insulating washer maintained in abutting relation to said second cone shaped retainer by said spring, an angular lip on said first cone shaped retainer to prevent electrically conductive liquid from returning to said well after such liquid has escaped therefrom, and slots in said second cone shaped retainer adapted to be aligned with said slots in said first retainer when said second cone shaped retainer is depressed by a force applied to said electrically conductive pin and thereby permit electrically conductive liquid to return to said well in said casing.

10. The switch of claim 8 in which the lip of said first retainer is at an angle of about 25° to about 50°.

11. The switch of claim 10 in which said angle is from about 35° to about 45°.

12. The switch of claim 1 in which the lip of said first retainer is at an angle of about 25° to about 50°.

13. The switch of claim 12 in which said angle is from about 35° to about 45°.

14. The switch of claim 4 in which the lip of said first retainer is at an angle of about 25° to about 50°.

15. The switch of claim 14 in which said angle is from about 35° to about 45°.

* * * * *